US007476006B2

(12) United States Patent
Hinds

(10) Patent No.: US 7,476,006 B2
(45) Date of Patent: Jan. 13, 2009

(54) AUTOMATED LIGHTING SYSTEM WITH EXTENDABLE AND RETRACTABLE LIGHT UNITS

(76) Inventor: Kenneth A. Hinds, 8523 Alden St., Lenexa, KS (US) 66215-2474

( * ) Notice: Subject to any disclaimer, the term of this patent is extended or adjusted under 35 U.S.C. 154(b) by 197 days.

(21) Appl. No.: 11/485,134

(22) Filed: Jul. 12, 2006

(65) Prior Publication Data

US 2008/0013317 A1 Jan. 17, 2008

(51) Int. Cl.
*F21S 8/00* (2006.01)

(52) U.S. Cl. ..... 362/286; 362/153; 362/386

(58) Field of Classification Search ..... 362/386, 362/286, 285, 289, 153, 153.1, 364, 365, 362/372, 223, 422, 427; 310/12–14
See application file for complete search history.

(56) References Cited

U.S. PATENT DOCUMENTS

| | | | | | |
|---|---|---|---|---|---|
| 3,660,651 | A | * | 5/1972 | Miles, Jr. | 362/366 |
| 4,180,850 | A | * | 12/1979 | Bivens | 362/285 |
| 4,392,187 | A | * | 7/1983 | Bornhorst | 362/233 |
| 4,974,134 | A | * | 11/1990 | Bourne | 362/286 |
| 4,984,139 | A | * | 1/1991 | Goggia | 362/153.1 |
| 5,003,441 | A | * | 3/1991 | Crowe et al. | 362/183 |
| 5,068,773 | A | | 11/1991 | Toth | |
| 5,072,345 | A | | 12/1991 | Goggia | |
| 5,075,834 | A | | 12/1991 | Puglisi | |
| 5,124,902 | A | | 6/1992 | Puglisi | |
| 5,130,916 | A | * | 7/1992 | Toth | 362/386 |
| 5,142,463 | A | * | 8/1992 | Panagotacos et al. | 362/285 |
| 5,144,542 | A | * | 9/1992 | Puglisi | 362/386 |
| 5,398,026 | A | * | 3/1995 | Handsaker | 340/984 |
| 5,513,085 | A | | 4/1996 | Bourne | |
| 5,550,727 | A | * | 8/1996 | Fenyvesy | 362/386 |
| 5,628,558 | A | * | 5/1997 | Iacono et al. | 362/288 |
| 5,733,021 | A | * | 3/1998 | O'Neill et al. | 312/114 |
| 6,305,820 | B1 | * | 10/2001 | Poon | 362/186 |
| 6,626,606 | B1 | * | 9/2003 | Johnson | 404/6 |
| 7,080,816 | B1 | * | 7/2006 | Vaccaro | 248/545 |
| 7,261,443 | B1 | * | 8/2007 | Hayes, Jr. | 362/385 |

* cited by examiner

*Primary Examiner*—Bao Q Truong
*Assistant Examiner*—Gunyoung T. Lee

(57) ABSTRACT

A lighting system includes multiple extendable and retractable light units. Each light unit includes a housing with inner and outer sleeves, which are telescopically interconnected. A drive assembly is located in each housing for extending and retracting the inner sleeve whereby a luminaire mounted in the inner sleeve can be selectively elevated. The housings are adapted for flush-mounting in the ground with their inner sleeves retracted. The lighting system can include a centralized control subsystem for collectively and individually operating the individual light units.

5 Claims, 10 Drawing Sheets

AUTOMATED LIGHTING SYSTEM WITH EXTENDABLE AND RETRACTABLE LIGHT UNITS

BACKGROUND OF THE INVENTION

1. Field of the Invention

The present invention relates generally to lighting systems, and in particular to an automated lighting system with extendable and retractable light units controlled by a centralized control system.

2. Description of the Related Art

Lighting systems are available in a wide variety of designs, which accommodate various lighting applications and environments. For example, fixed-position lighting systems are commonly used for applications with relatively constant conditions. Other lighting systems can be repositioned as needed for particular illumination tasks. Both fixed-position and movable lighting systems are used for indoor and outdoor applications. Outdoor lighting applications present several challenges to the designer. For example, ambient weather conditions must be considered and can include precipitation, temperature extremes, ultraviolet (UV) radiation, etc.

Another consideration affecting lighting design relates to concealing and/or otherwise protecting the lighting fixtures or units when they are not being used. For example, landscape lights are generally associated with exterior applications and can be used for illuminating and accentuating landscape designs. Low voltage power supplies (e.g., 12 V) are commonly used to reduce electrical shock hazards and to enable multiple light units to receive power via light gauge electrical leads from common power sources. Such power sources are commonly connected to the power systems of buildings and the transformed electrical power is distributed to multiple lighting units around the premises. For example, a common application for low-voltage lighting systems relates to illuminating walkways, driveways and other circulation structures for pedestrians and vehicles. Such light fixtures can be conveniently installed in the ground with the wiring runs between the power source and the fixtures buried below grade. Ground-mounted systems can effectively illuminate the ground-level surfaces of circulation structures such as driveways and walkways, and are particularly effective and attractive in applications not requiring general illumination.

In many applications, particularly outdoors, it would be advantageous to retract the light fixtures below grade for protection from surface traffic, such as vehicles, pedestrians and maintenance equipment. Maintenance, such as mowing, snow removal, etc., can be performed more efficiently if the light fixtures are temporarily retracted into below-grade receptacles.

Such extendable and retractable fixtures have previously been proposed. For example, U.S. Pat. Nos. 5,075,834; 5,513,085; 5,068,773; 5,072,345 and 5,124,902 all show retractable light fixtures. However, heretofore there has not been available an extendable/retractable light fixture with the advantages and features of the present invention.

SUMMARY OF THE INVENTION

In the practice of an aspect of the present invention, an extendable and retractable light unit is provided. Multiple light units can be configured in an automated lighting system, which can be interconnected by a power and communication network with a centralized power source and controller. The controller can be programmable to control various functions of the individual light units, such as automatic extension/retraction, illumination, timing and various other functions permitting a wide range of lighting effects. The light units have first and second sleeves, which are telescopically interconnected and have extended and retracted positions with respect to each other. A luminaire is mounted in each second sleeve and is positioned to distribute light when the second sleeve is extended from the first. A drive mechanism includes a motor and an extension/retraction drive assembly connected thereto and to the sleeves for moving them between their extended and retracted positions.

DETAILED DESCRIPTION OF THE PREFERRED EMBODIMENTS

I. Introduction and Environment

Figure 1:
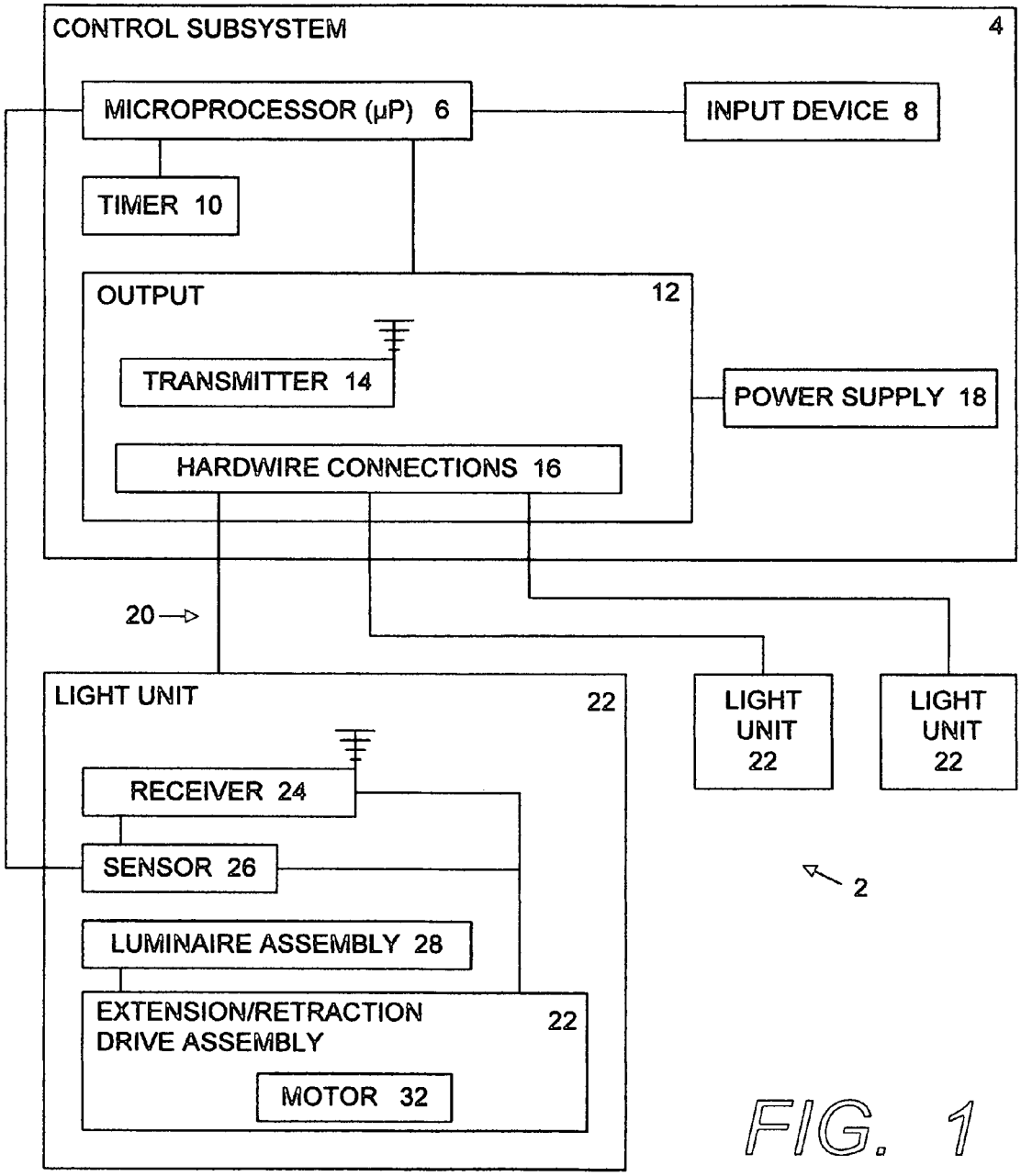
FIG. 1 is a block diagram of an automated lighting system embodying an aspect of the present invention and including multiple light units.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Certain terminology will be used in the following description for convenience in reference only and will not be limiting. Said terminology will include the words specifically mentioned, derivatives thereof and words of similar meaning.

Referring to the drawings in more detail, the reference numeral 2 generally designates an automated lighting system embodying an aspect of the present invention. A control subsystem 4 includes a microprocessor 6, which is preferably programmable and chosen for its suitability for the intended applications of the lighting system 2. An input device 8 can comprise any suitable device for providing an input to the microprocessor 6. For example, the input device 8 can comprise a keyboard, another microprocessor, storage media, sensors (e.g. photovoltaic, motion-sensing, sound-responsive, voice command, etc.), switching devices and other suitable input devices. A timer 10 can be connected to the microprocessor 6 and activate the system 2 at predetermined times and for predetermined intervals. For example, the system 2 might be active only during certain hours of darkness, which condition could also be sensed by a photovoltaic sensor input device.

An output 12 is connected to the microprocessor 6 and can include an optional transmitter 14 and hardwire connections 16, which can include both communication signals and power leads from a suitable power supply 18. The hardwire connections can extend to multiple light units 22 via a network 20. Alternatively or in addition to the hardwire network 20, control signals can emit from the transmitter 14 for wireless operation.

Multiple light units 22 are shown, but it will be appreciated that a single light unit 22 can operate in a stand-alone mode. For example, a photovoltaic cell and a rechargeable battery can comprise the power supply 18 whereby the light unit 22 can operate independently of external connections.

The light unit 22 can include an optional receiver 24, which can receive control signals from the transmitter 14. A sensor 26 in the light unit 22 can provide an input to the microprocessor 6. For example, the sensor 26 can comprise a photovoltaic resistor responding to ambient light conditions and providing an appropriate light level indicating signal to the microprocessor 6. A luminaire assembly 28 can comprise a suitable light source, which can vary considerably depending upon the desired lighting effects. For example, incandescent and fluorescent light fixtures can be installed in the unit 22. Moreover, LEDs can be utilized effectively, including applications with low voltage electrical power. The luminaire assemblies 28 can provide a wide range of lighting effects, including chromatics (color), blinking and flashing (strobe) effects. Another application of the system 2 is for airport lighting, e.g. airfield runway and taxiway lights. The light units 22 can be retracted into protected positions when not in use. The control subsystem 4 can operate the lights 22 according to predetermined sequences, color effects and other operational characteristics as necessary for airfield operations.

An extension/retraction drive assembly 30 is connected to the luminaire assembly 28, which is operated by a motor 32. The motor 32 can comprise any suitable motive source, including electrical motors, solenoids, piston-and-cylinder units (pneumatic and hydraulic), etc. The luminaire assembly 28 can be automatically activated, for example when the light unit is extended by the drive assembly 30. Electrical contact switches or other suitable devices can be utilized for such an automatic illumination function.

Figure 2:
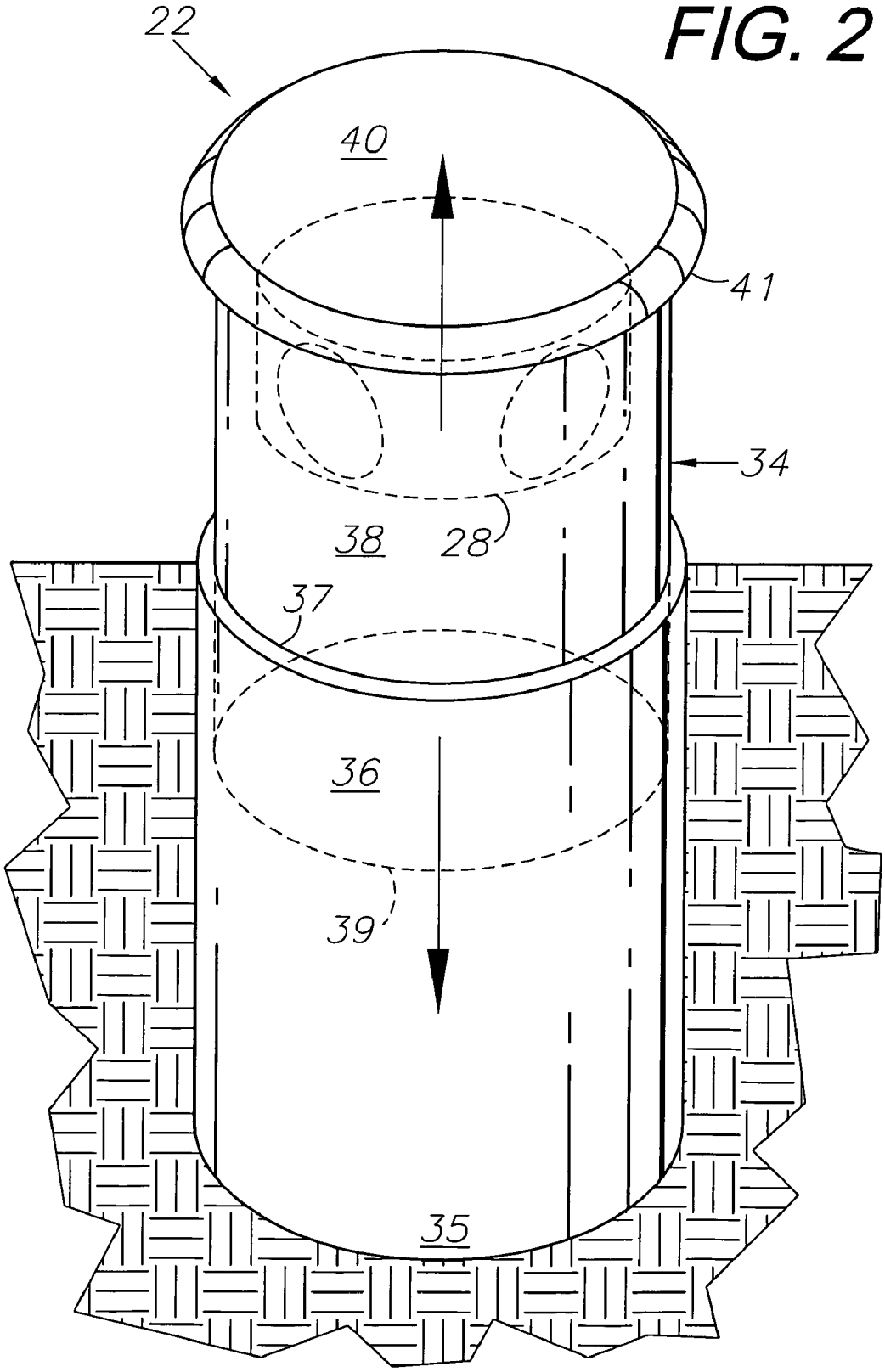
FIG. 2 is a perspective view thereof, showing an inner sleeve thereof extended.

FIG. 2 shows an in-ground application of the light unit 22 including a telescoping housing 34 with a lower, outer sleeve 36 located generally below grade and telescopically receiving an upper, inner sleeve 38 for raising and lowering between extended and retracted positions. The outer sleeve 36 includes proximate and distal ends 35, 37. The inner sleeve 38 includes proximate and distal ends 39, 41. A cap 40 is mounted on the distal end 41 of the inner sleeve 38 and can comprise a light-transmitting material. The cap 40 can have various configurations, including cylindrical, domed, etc., and can comprise a light-transmitting lens.

Figure 3:
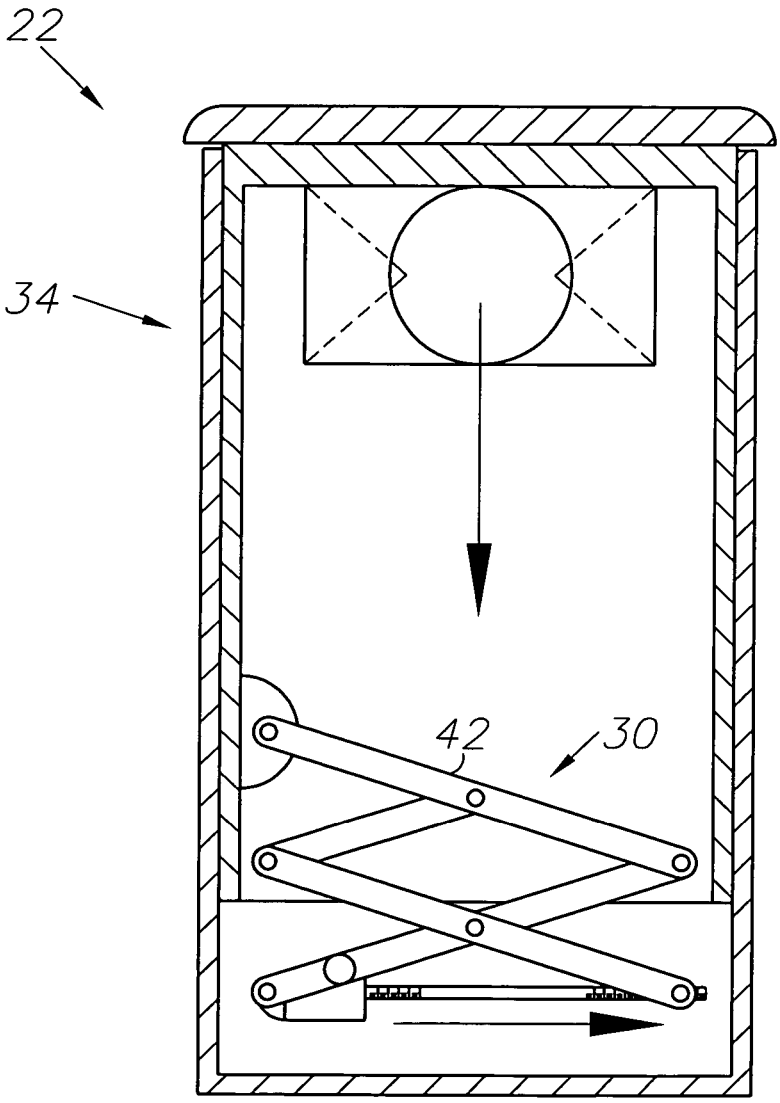
FIG. 3 is a vertical, cross-sectional view of a light unit with a scissor jack extension/retraction drive assembly, showing the inner sleeve retracted.
Figure 4:
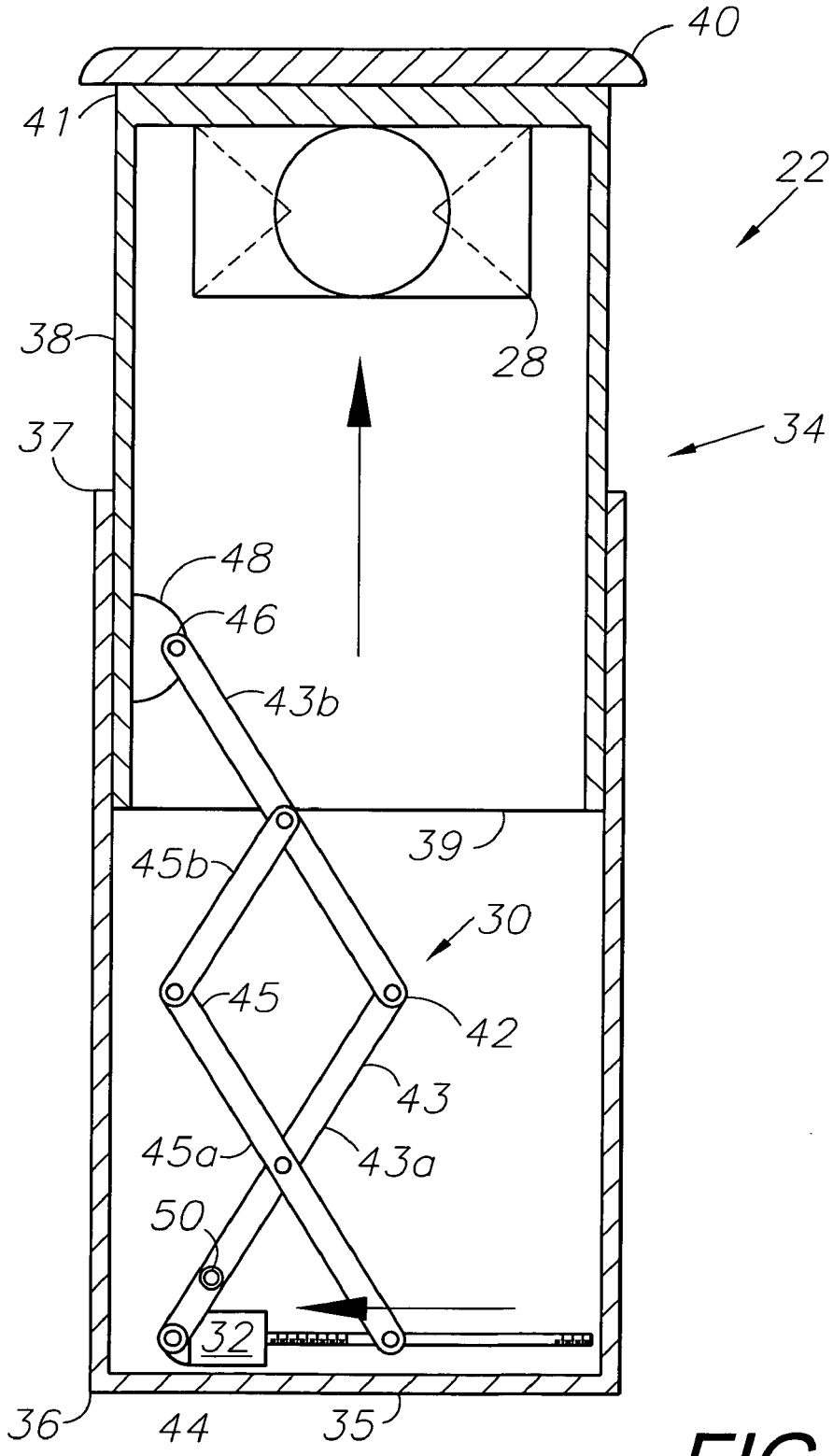
FIG. 4 is a vertical, cross-sectional view thereof, showing the inner sleeve extended.

FIGS. 3 and 4 show an aspect of the invention wherein drive assembly 30 of the light unit 22 includes a reversible, DC motor 32 drivingly connected to a threaded rod 34, which is threadably connected to a scissor jack 42 at a lower end 44 thereof. An upper end 46 of the scissor jack 42 is connected to a boss 48 extending into the interior of the inner sleeve 38. As shown in FIG. 4, the inner sleeve 38 is extended by turning the motor 32 in a first direction and thereby expanding the scissor jack 42. Turning the motor 32 in a second, opposite direction contracts the scissor jack 42 and retracts the inner sleeve 38. The scissor jack 42 includes a first articulated linkage 43 with upper and lower arms 43*a*, 43*b* and a second articulated linkage 45 with upper and lower arms 45*a*, 45*b*. The scissor jack 42 can optionally comprise opposed pairs of articulated linkages 43, 45, with the motor 32 and the boss 48 located therebetween. A pivot pin 50 extends through the scissor jack 42 in proximity to its lower end 44 and is embedded in or otherwise attached to the outer sleeve 36 in proximity to its proximate end 35.

Figure 5:
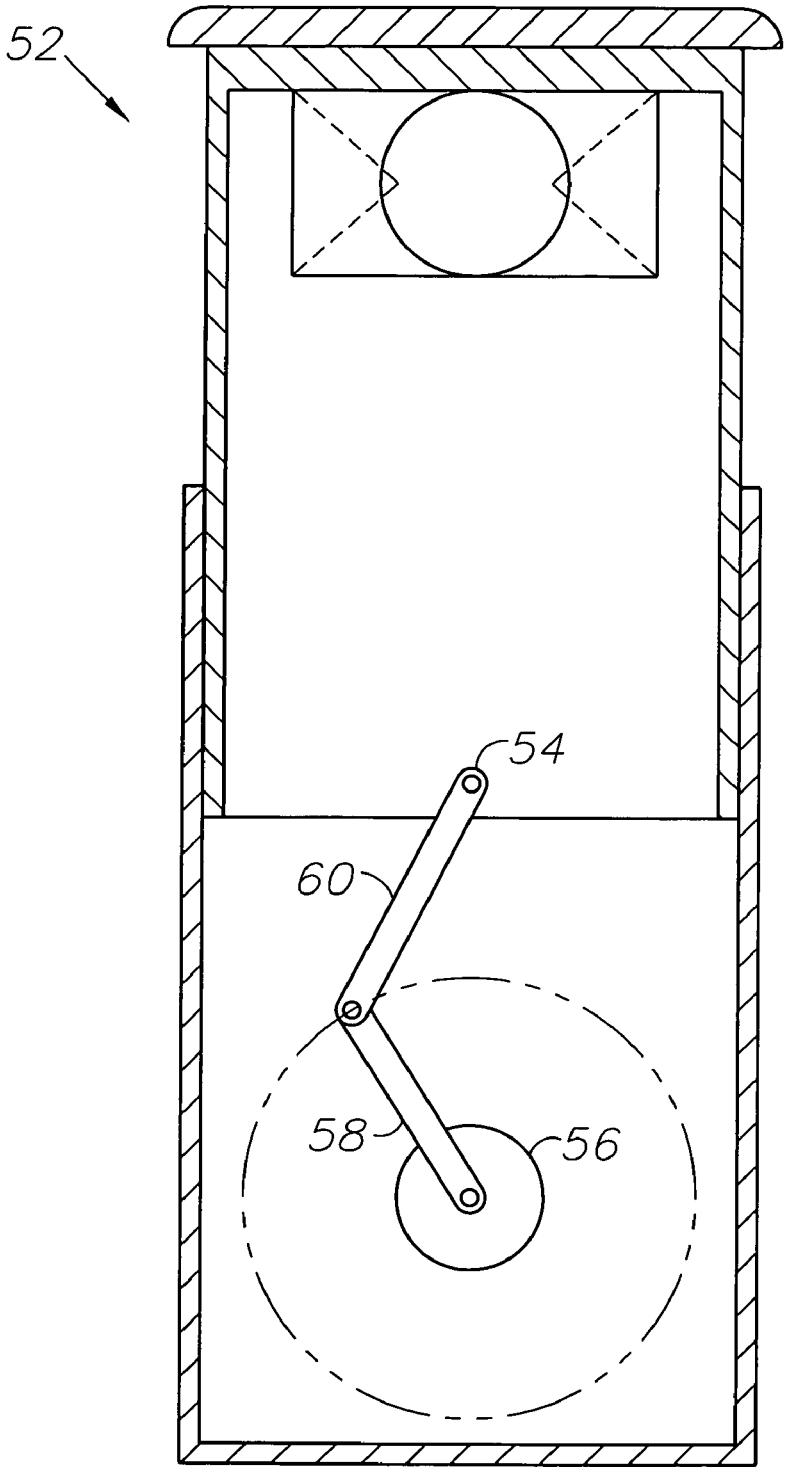
FIG. 5 is a vertical, cross-sectional view of another aspect of the invention, with a crank arm extension/retraction drive assembly.
Figure 7:
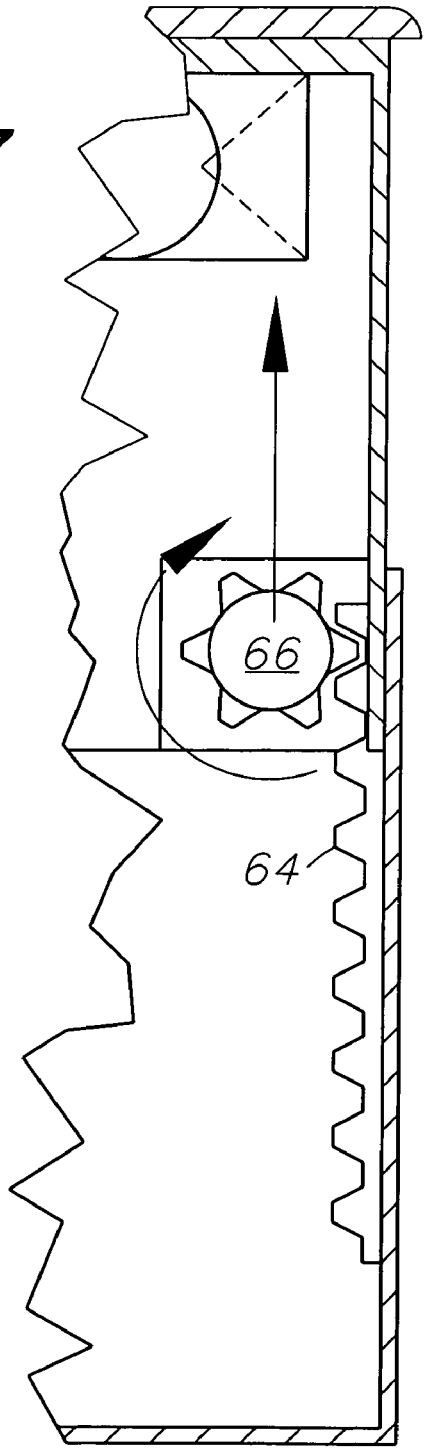
FIG. 7 is a fragmentary, vertical, cross-sectional view thereof, with the inner sleeve extended.
Figure 6:
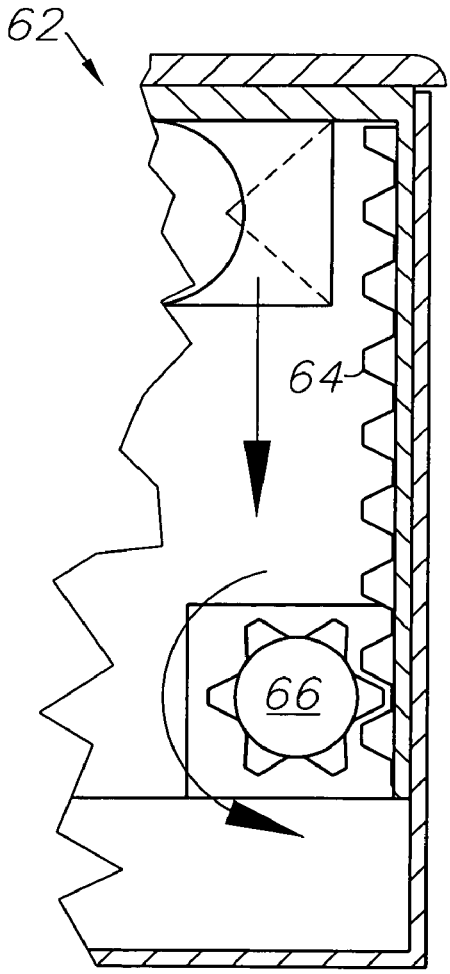
FIG. 6 is a fragmentary, vertical, cross-sectional view of another aspect of the invention, with a rack-and-opinion extension/retraction drive assembly and the inner sleeve retracted.

FIG. 5 shows a light unit 52 comprising an alternative aspect or embodiment of the invention with a crank arm drive assembly 54, which includes a DC electric motor 56 mounting a crank arm 58 connected to a linking arm 60, which in turn is pivotally connected to the inner sleeve 38. Rotating the motor 56 (in either direction) raises and lowers the inner sleeve 38 between its extended and retracted positions. FIGS. 6 and 7 show a light unit 62 comprising another modified embodiment or aspect of the invention and including a rack-and-pinion drive assembly 64, which is adapted for lowering (retracting) the inner sleeve 36 when a pinion 66 rotates counterclockwise (as viewed in FIG. 6) and for raising (extending) the inner sleeve 36 when the pinion 66 rotates clockwise.

Figure 8:
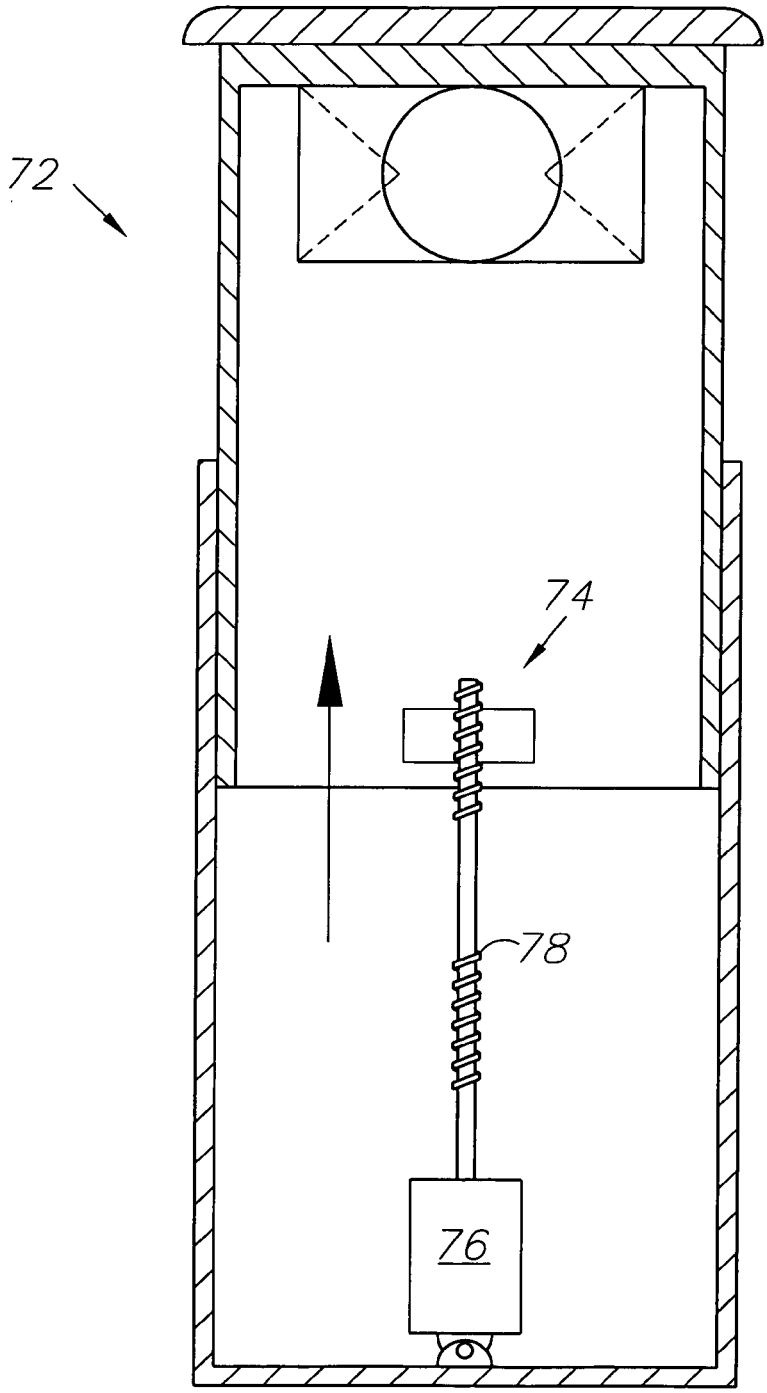
FIG. 8 is a vertical, cross-sectional view of another aspect of the invention, with a threaded rod extension/retraction drive assembly.
Figure 9:
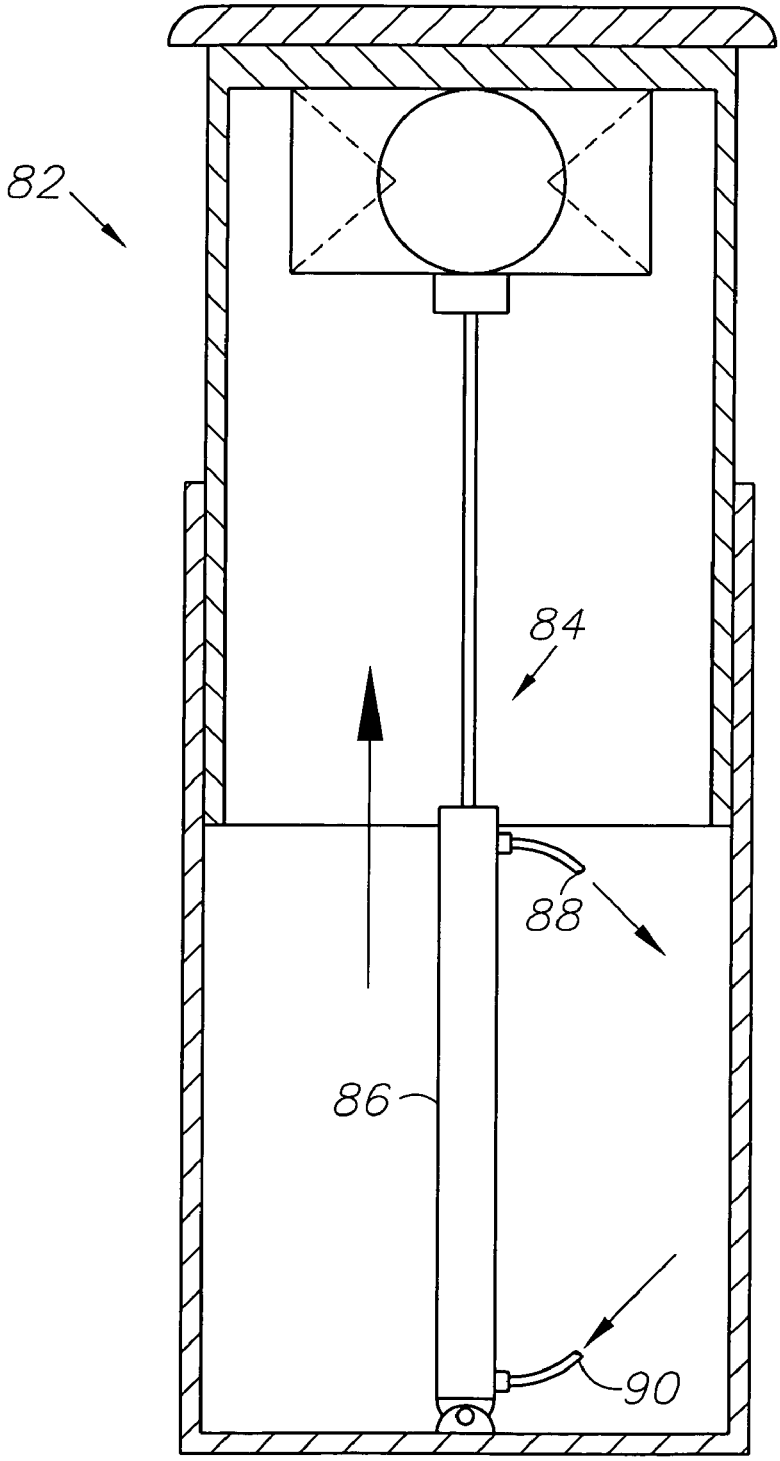
FIG. 9 is a vertical, cross-sectional view of another aspect of the invention, with a piston-and-cylinder unit extension/retraction drive assembly.

FIG. 8 shows a light unit 72 comprising another alternative aspect or embodiment of the present invention and including a drive assembly 74 including a reversible, DC electric motor 76 drivingly connected to a threaded rod 78 connected to and adapted for extending and retracting the inner sleeve 38. FIG. 9 shows a light unit 82 comprising another alternative aspect or embodiment of the present invention with a fluid-powered drive assembly 84 including a piston-and-cylinder unit 86 with upper and lower fluid lines 88, 90. The centralized power supply 18 can include, in addition to an electrical power source, a fluid power source such as a compressor or an hydraulic pump for driving the piston-and-cylinder unit 86. A suitable network of air or hydraulic fluid lines can be extended from the centralized power supply 18 to the individual light units 82. Alternatively, individual fluid power sources can be provided for each light unit 82 and individually or collectively controlled by the control subsystem 4. The piston-and-cylinder unit 86 can be either single-acting with a return spring or double-acting for a fluid power return stroke.

Figure 10:
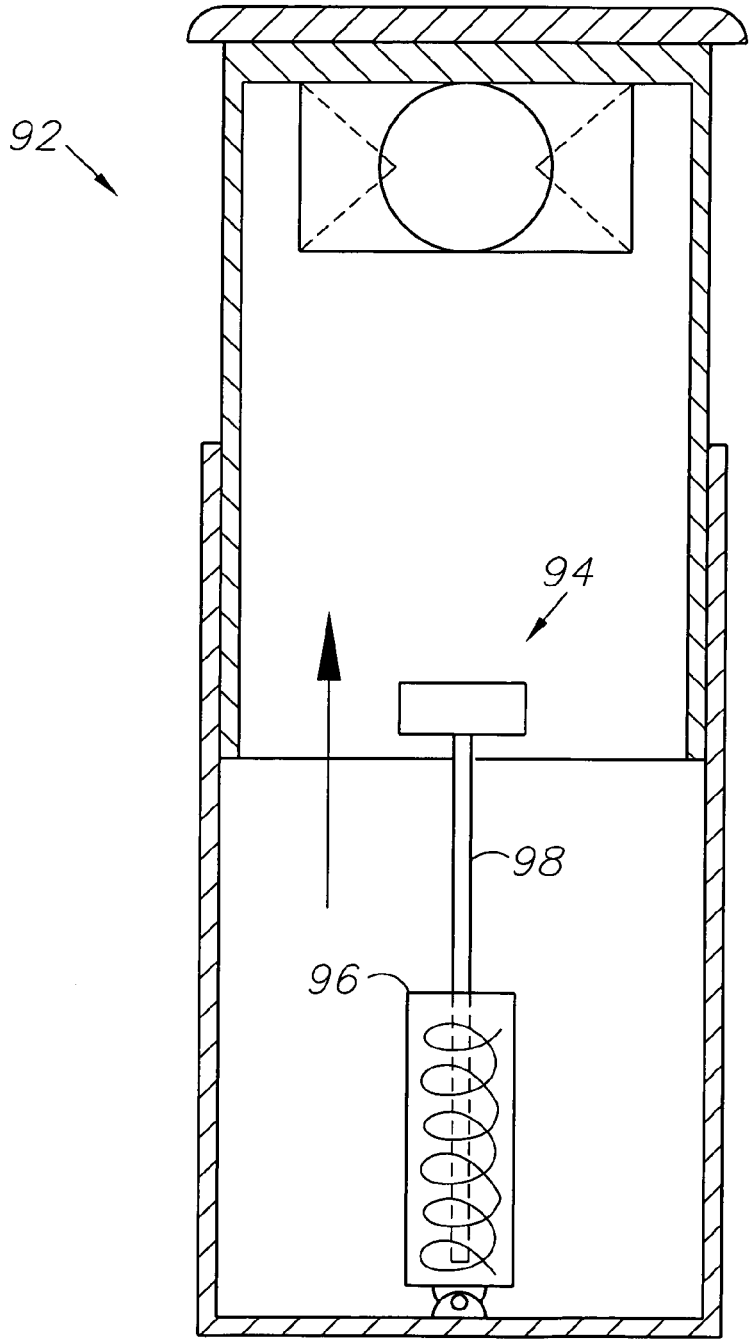
FIG. 10 is a vertical, cross-sectional view of another aspect of the invention, with a solenoid extension/retraction drive assembly.
Figure 11:
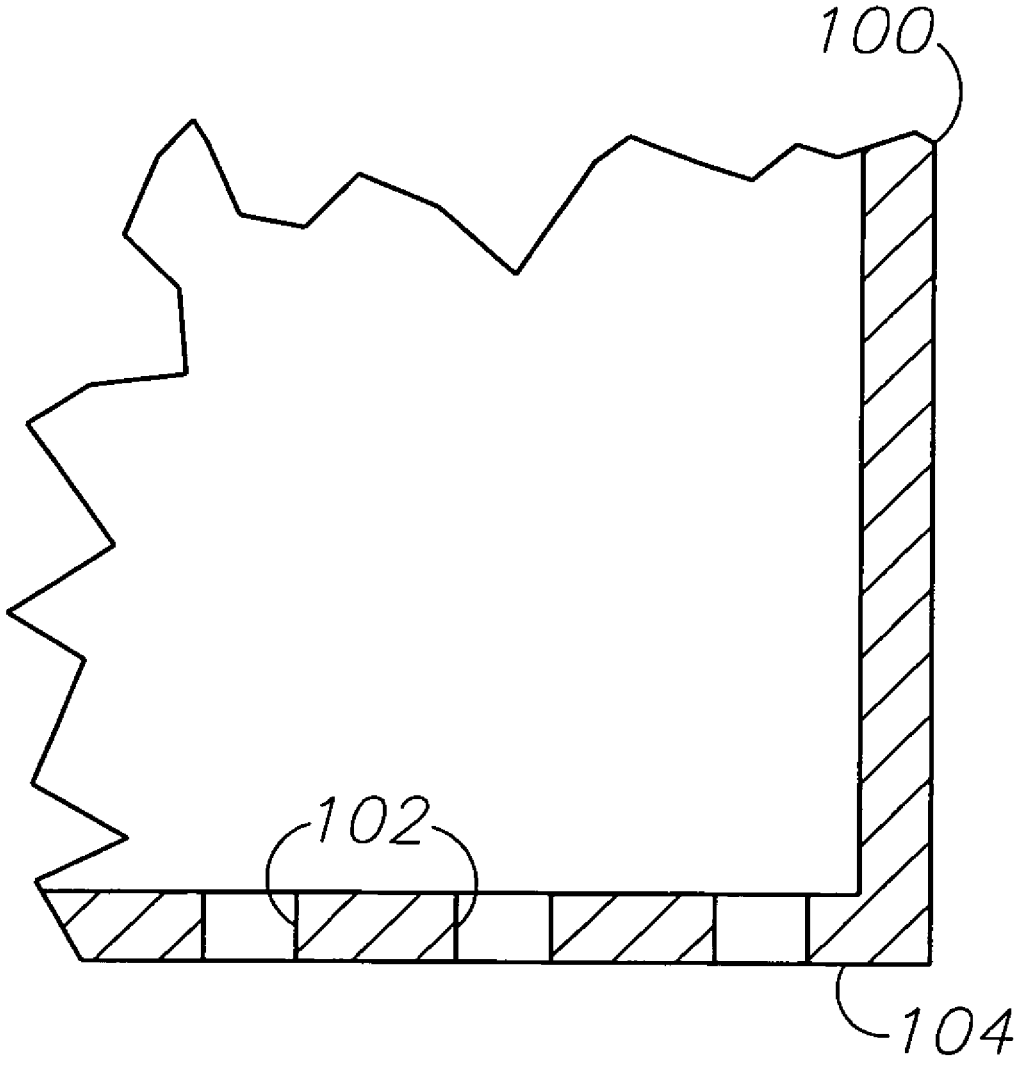
FIG. 11 is a vertical, cross-sectional view of another aspect of the invention, with drainholes in a bottom of an outer sleeve thereof.

FIG. 10 shows a light unit 92 comprising another alternative aspect or embodiment of the present invention with a drive assembly 94 including a solenoid 96 connected at a lower end thereof to the outer sleeve 36 and connected to the inner sleeve 38 at an upper end of an actuating rod 98 thereof. FIG. 11 shows a modified outer sleeve 100 with multiple drain passages or perforations 102 located in a perforated base 104 of the modified outer sleeve 100. The outer sleeve 100 is thereby adapted to drain. Alternatively, the housing 34 can be constructed with suitable seals and watertight construction for maintaining a relatively dry interior, even when buried in soil conditions susceptible to high moisture contents and flooding.

In operation the lighting system 2 can be preprogrammed for a wide variety of special effects. For example, extension and retraction of the light units can be timed for operation during predetermined hours of darkness. Photovoltaic sensors can be provided for automatically actuating the extension/retraction mechanisms in response to predetermined light levels. The light units can be preprogrammed for sequential operation and various other operating sequences, including random operation.

The luminaire assemblies 28 can utilize various lighting technologies in order to achieve desired operating and lighting effects. For example, incandescent, fluorescent, LED and other lighting technologies can be utilized. The luminaire assemblies can comprise multiple individual lights, which in turn can have different characteristics such as color, intensity, directional orientation, etc. The individual lights within the light units can also be individually controlled for sequencing and timing effects.

It is to be understood that the invention can be embodied in various forms, and is not to be limited to the examples discussed above. Other components and configurations can be utilized in the practice of the present invention.

The invention claimed is:

1. An extendable/retractable light unit, which includes:

a telescopic housing with an outer sleeve having proximate and distal ends and an inner sleeve having proximate and distal ends, said sleeves being telescopically interconnected;

a luminaire connected to said inner sleeve and located in proximity to the distal end thereof;

a drive mechanism including a motor connected to one of said sleeves and an extension/retraction mechanism connected to said motor and the other of said sleeves for extending and retracting said inner sleeve relative to said outer sleeve between extended and recessed positions;

said drive mechanism including a scissor jack including first and second pivotally interconnected, articulated linkages;

each said linkage comprising pivotally interconnected arms;

said first linkage being pivotally connected to said outer and inner sleeves in proximity to the proximate ends of said outer and inner sleeves;

said first linkage being connected to said motor whereby activating said motor folds and unfolds said linkages relative to each other;

said motor having a first, extension direction of operation for unfolding said linkages and a second, retraction direction of operation for folding said linkages relative to each other whereby said scissor jack respectively extends and retracts said inner sleeve telescopically relative to said outer sleeve, said motor comprising a reversible, electric motor connected to one of said linkages and each said drive mechanism includes a threaded rod connected to said motor and threadably connected to said second linkage; and said drive mechanism including a pair of pivot pins extending transversely through said first and second linkages and connected to said inner and outer sleeves in proximity to said inner and outer sleeve proximate ends.

2. The light unit according to claim 1 wherein said motor comprises a reversible, electric motor connected to one of said linkages and said drive mechanism includes a threaded rod connected to said motor and threadably connected to said other linkage.

3. The light unit according to claim 2, which includes:

said scissor jack comprising a pair of first linkages positioned in parallel, spaced relation and a pair of second linkages positioned in parallel, spaced relation; and a pivot pin extending transversely through said first linkages and connected to said first sleeve in proximity to its proximate end.

4. The light unit according to claim 1 wherein said outer sleeve includes a perforated base.

5. A lighting system, which comprises:

multiple extendable/retractable light units each having extended and retracted positions, bodies with telescopically interconnected inner and outer sleeves with proximate and distal ends, an extension/retraction drive assembly including a motor and an extension/retraction drive mechanism drivingly connected to said motor and to said sleeves and a luminaire connected to said inner sleeve;

each said light unit including a cap mounted on a respective inner sleeve distal end;

said light units being movable between their extended and retracted positions by said drive assemblies and substantially recessed in their retracted positions;

each said drive mechanism including a scissor jack including first and second pivotally interconnected, articulated linkages;

each said linkage comprising pivotally interconnected arms;

each said first linkage being pivotally connected to said outer and inner sleeves in proximity to the proximate ends of said outer and inner sleeves;

each of said first and second linkages being connected to said motor whereby activating said motor folds and unfolds said linkages relative to each other;

each said motor having a first, extension direction of operation for unfolding said linkages and a second, retraction direction of operation for folding said linkages relative to each other whereby said scissor jack respectively extends and retracts said inner sleeve telescopically relative to said outer sleeve, each said motor comprising a reversible, electric motor connected to one of said linkages and each said drive mechanism includes a threaded rod connected to said motor and threadably connected to the other said linkage;

each said drive mechanism including a pair of pivot pins extending transversely through said first and second linkages and connected to said inner and outer sleeves in proximity to said inner and outer sleeve proximate ends;

a control subsystem including a programmable microprocessor;

an input device for providing an input to said microprocessor, said input corresponding to a predetermined operation of said light units including extension, retraction and illumination;

a hardware network connecting said control subsystem to said light units and providing electrical power and signal communications to said light units individually; and said microprocessor having an output connected to said light units for transmitting an operational control signal to said light units.

* * * * *